United States Patent [19]

Bost

[11] Patent Number: 4,947,495

[45] Date of Patent: Aug. 14, 1990

[54] DEFLECTOR FOR POOL CLEANER IN ABOVEGROUND SWIMMING POOLS

[76] Inventor: Benjamin M. Bost, 13801 N.W. 4th St., Sunrise, Fla. 33325

[21] Appl. No.: 359,265

[22] Filed: May 31, 1989

[51] Int. Cl.[5] ..... E04H 3/18

[52] U.S. Cl. ..... 4/496; 4/490; 4/661

[58] Field of Search ..... 4/496, 661, 503, 490, 4/501, 504; 15/50 R

[56] References Cited

U.S. PATENT DOCUMENTS 3,667,070 6/1972 Pitti et al. ..... 4/503
4,048,678 9/1977 Chillino ..... 4/503
4,429,429 2/1984 Altschul ..... 134/167 R X
4,856,124 8/1989 McJunkin ..... 4/496

*Primary Examiner*—Henry K. Artis

[57] ABSTRACT

Aboveground swimming pools employ ladders for permitting pool ingress and egress. Attempts to employ automatic swimming pool cleaners in aboveground pools have heretofore resulted in the cleaner becoming stuck against the sides of the pool ladder. The invention consists of a deflector member, arcuately curved and formed of flexible material, which is placed on the pool bottom to extend between the side of the ladder and the pool wall. Two such deflector members may be used, one on each side of the ladder, to prevent the pool cleaner from becoming stuck.

9 Claims, 2 Drawing Sheets

DEFLECTOR FOR POOL CLEANER IN ABOVEGROUND SWIMMING POOLS

This invention relates to a deflector member for use in aboveground swimming pools to prevent a pool cleaner from becoming stuck against the sides of the pool ladder.

The use of automatic swimming pool cleaners has become widespread over the years in inground pools. Such cleaners typically will be connected by a flexible hose to the pool's suction system such that suction caused by the normal operation of the pool's filtration system pump will cause the pool cleaner to move across the bottom, and often up the walls, in a random path of motion, sucking up dirt and debris along the way. An example of such a pool cleaner is shown in U.S. Pat. No. 4,023,227 issued to F. L. O. J. Chauvier.

While such pool cleaners have been successfully used in a wide variety of inground swimming pools, they have heretofore not proved fully successful in aboveground swimming pools. One of the principal reasons for this lack of success has been the tendency of the cleaner to become stuck or lodged against the pool ladder in such pools. Unlike inground pools where the ladder is either suspended from the pool deck or created by steps recessed into the side of the pool, aboveground pools use a ladder very similar to a stepladder to accomplish pool ingress and egress. Since the sidewall of the aboveground pools cannot employ recessed steps or support suspended steps, the pool ladder for such pools consists of a set of steps or stairs which depend into the pool and rest upon the bottom thereof. If an automatic swimming pool cleaner is introduced into such a pool, it has a tendency to become stuck or lodged against the side of the pool ladder or between the pool ladder and the sidewall of the pool. This requires the pool owner to constantly visit the pool to free the cleaner from its stuck position, which, in turn, vitiates the "automatic" nature of the pool cleaner.

The present invention attempts to overcome this problem by providing a deflector member which can be positioned on the bottom of an aboveground swimming pool, spanning the area between the sides of the pool ladder and the pool wall. When two deflector members are employed, one on each side of the ladder posts, the pool cleaner is unable to become lodged or stuck in position as a result of contact against the pool ladder. If the pool cleaner is of the type which has a programmed path or pattern of movement, one deflector member may be all that is required to prevent the pool cleaner from becoming stuck.

As will be explained in detail hereinafter, the deflector member of the present invention is an inexpensive product which can be folded to very compact size when not in use, yet can be quickly filled with a mixture of sand and water and placed on the pool bottom to accomplish the desired result. The deflector member is an arcuately curved hollow member formed of flexible material, having a concave front side, a convex rear side, and rounded ends. A filling aperture in the upper surface is normally closed by a recessed stopper.

Referring now to the drawings which form a part of this original disclosure:

Figure 3:
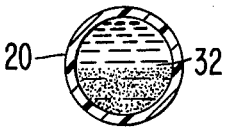
FIG. 3 is a transverse sectional view thereof taken along the line 3—3 of FIG. 1.

Referring now to the drawings in further detail for a detailed description of the preferred embodiment of the present invention, the deflector member is generally designated 20. It is formed of a body 22 of flexible material, advantageously vinyl sheet. Although as shown in FIG. 3, the body is generally circular in cross-section, it can nonetheless be considered as having an upper surface 24 and a lower surface 26. The lower surface 26 is adapted to rest upon the pool bottom while the upper surface 24 is disposed closer to the water surface in the pool.

Figure 1:
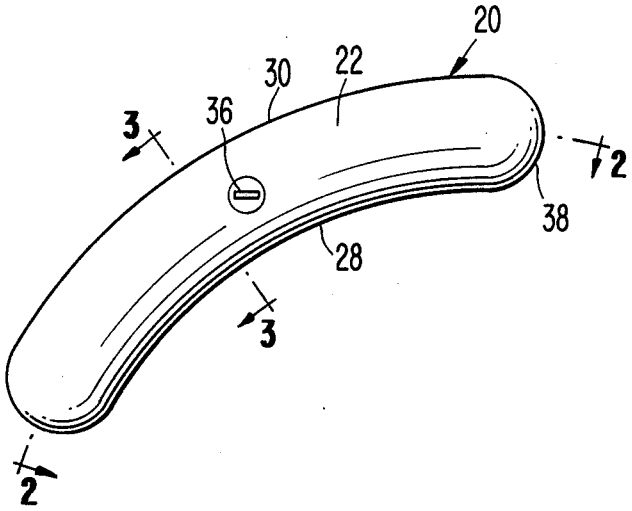
FIG. 1 is a top plan view of a deflector member in accordance with the present invention.

The body 20 is arcuately curved, as shown in FIG. 1, to provide a concave side 28 and a convex side 30. The body 20 is hollow and has an interior cavity 32, as shown in FIG. 3. An aperture means and removable stopper are provided in the upper surface 22 and the stopper consists of a threaded plug 36 which screws into the threaded ring 34. The ends 38 of the member 20 are rounded, as shown in FIG. 1.

Figure 4:
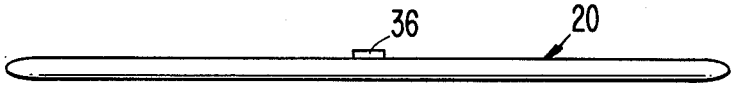
FIG. 4 is a side elevational view of the deflector in its collapsed position.

When the cavity 32 is empty, the member 20 can be folded to its flat, collapsed position of FIG. 4, merely by removing the plug 36 to permit any entrapped air to escape. In this collapsed position, the member can be folded into a small palm-sized unit which facilitates storage and shipping.

Figure 2:
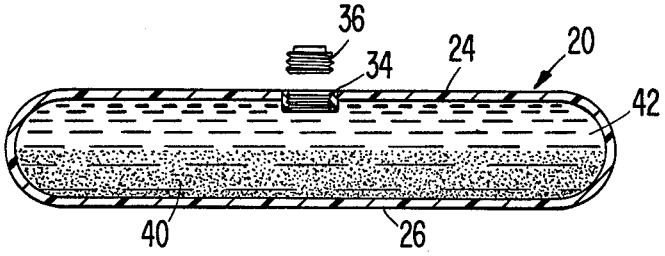
FIG. 2 is a longitudinal section view thereof along the line 2—2 of FIG. 1.

To prepare the member 20 for use, the plug 36 is removed and the cavity 32 is filled with a mixture of a weighted composition 40, advantageously silica sand, and water 42, as shown in FIG. 2. This filling operation will normally be performed at the pool site by the poolowner or the pool serviceman.

Figure 5:
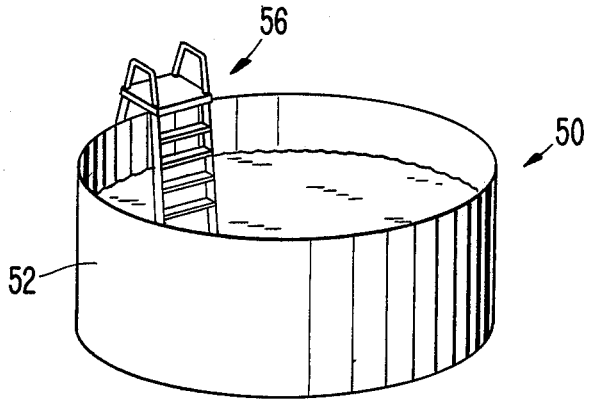
FIG. 5 is a perspective view of an aboveground swimming pool and pool ladder.
Figure 6:
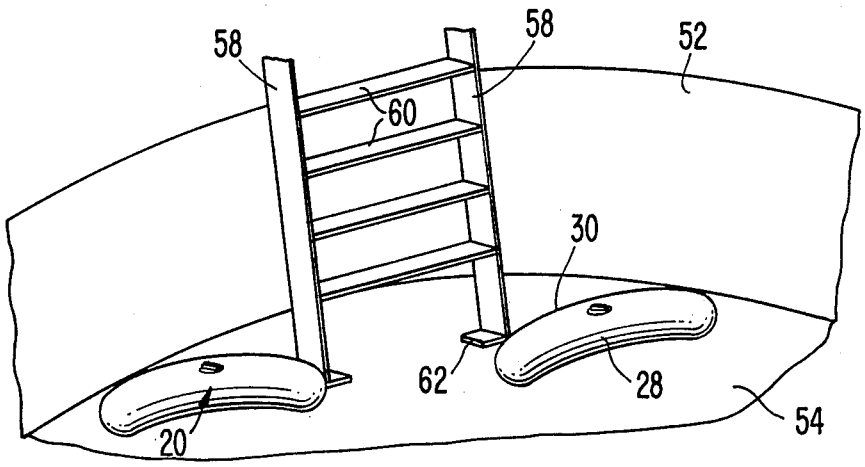
FIG. 6 is a fragmentary perspective view showing a portion of the pool and ladder, and showing a pair of deflector members positioned at their proper location for use.

A typical aboveground pool generally designated 50 is shown in FIGS. 5 and 6. The pool includes an upstanding side wall 52 which circumscribes and defines the pool and a flat or slightly concave bottom 54 which extends across the pool and encloses the bottom thereof to permit the pool to receive and retain water. A pool ladder generally designated 56 provides ingress and egress to the pool. The ladder 56 includes a pair of spaced side rails 58 having steps 60 extending therebetween. The bottom ends 62 of the ladder rails rest or abut against the pool bottom 54.

As shown in FIG. 6, two deflector members 20 are employed, one adjacent to each of the ladder side rails 58. The members are positioned with their bottom surfaces 26 resting upon the pool bottom 54 and the plug members 36 facing upward. More significantly, the deflector members are positioned as shown in FIG. 6 with one end thereof abutting against each side rail 58 at the bottom 62 thereof and the other end abutting against the pool wall 52. Also, the concave side 28 of the deflector members is directed toward that portion of the pool wall which runs behind the ladder 56.

The use of the deflector members, positioned as shown in FIG. 6, assures that if an automatic swimming pool cleaner is introduced into the pool 50, it cannot become stuck or lodged between the ladder 56 and the pool wall 58. As the cleaner moves toward such a position, it will first contact the deflector member, either along the concave side 28 or the rounded ends 38 thereof. As a result of such contact, the cleaner will either be deflected away from the ladder sides or will be caused to reverse or alter direction, depending upon the type of cleaner involved.

Due to the small size and inexpensive nature of the deflector members, they can easily be added to existing aboveground pools for small expense. Also, due to the simple nature of the deflector members, they can be easily filled and installed on site by any poolowner and there is no need for any special skills or tools to place the filled members in their position, ready for use.

Various changes or modifications apparent to those skilled in the art may be made without departing from the spirit and scope of the invention as defined in the appended claims.

What is claimed is:

1. In the combination of an aboveground swimming pool having an upstanding pool wall, a ladder having stairs projecting into the pool and abutting against the bottom thereof to permit ingress and egress, and an automatic swimming pool cleaner movable across the pool bottom for cleaning thereof, the improvement which comprises:

means for preventing the pool cleaner from becoming stuck against the ladder;

said means comprising deflection member means removably disposed on the bottom of said pool adjacent the sides of the ladder;

said deflection member means abutting at one end thereof against the pool wall and at the other end thereof against the sides of said ladder;

said deflection member means being hollow and being at least partially filled with a composition of sufficient weight to maintain them in their position on the bottom of said pool.

2. The improvement defined in claim 1 wherein said deflection member means are provided with a removable stopper to permit said composition to be introduced thereinto.

3. The improvement defined in claim 1 wherein said deflection member means are arcuately curved with their convex side being disposed toward that portion of said pool wall which extends behind the ladder and their concave side being disposed toward the center of the pool.

4. The improvement defined in claim 1 wherein said deflection member means are formed of flexible material.

5. The improvement defined in claim 2 wherein said composition is sand.

6. The improvement defined in claim 5 wherein said defenction member means are at least partially filled with water, in addition to said sand.

7. The improvement defined in claim 1 wherein said deflection member means includes two separate deflection members, one disposed adjacent to each side of the stairs.

8. In the combination of an above ground swimming pool having a ladder projecting into the pool, an automatic swimming pool cleaner and a deflection member for preventing the swimming pool cleaner from becoming stuck against the ladder, the improvement being in the deflection member which comprises:

a hollow tubular arcuately curved body for removable placement adjacent the side of the ladder and of sufficient length to abut against a wall of said swimming pool;

said body being fabricated of flexible material;

said body having a generally circular cross-sectional configuration with an upper and lower surface;

aperture means in said upper surface; and stopper means removably disposed in said aperture means to enable said hollow body to be filled with a mixture of water and sand.

9. A member as defined in claim 8 wherein the ends thereof are rounded.

* * * * *